US006676404B2

(12) United States Patent
Lochschmied

(10) Patent No.: US 6,676,404 B2
(45) Date of Patent: Jan. 13, 2004

(54) MEASURING DEVICE FOR A FLAME

(75) Inventor: Rainer Lochschmied, Karlsruhe (DE)

(73) Assignee: Siemens Building Technologies AG (CH)

( * ) Notice: Subject to any disclaimer, the term of this patent is extended or adjusted under 35 U.S.C. 154(b) by 0 days.

(21) Appl. No.: 09/846,700

(22) Filed: May 1, 2001

(65) Prior Publication Data

US 2002/0004186 A1 Jan. 10, 2002

(30) Foreign Application Priority Data

May 12, 2000 (DE) ..... 100 23 273

(51) Int. Cl.[7] ..... F23N 5/00
(52) U.S. Cl. ..... 431/75; 431/25; 340/579
(58) Field of Search ..... 431/75, 77, 78, 431/25; 340/579

(56) References Cited

U.S. PATENT DOCUMENTS 3,627,458 A * 12/1971 Wade ..... 307/653
3,726,630 A * 4/1973 Potts ..... 431/254
3,766,441 A * 10/1973 Gray ..... 340/579
4,088,984 A * 5/1978 Muramoto et al. ..... 340/579
4,672,324 A * 6/1987 van Kampen ..... 307/653
4,871,307 A * 10/1989 Harris et al. ..... 327/512
5,472,337 A * 12/1995 Guerra ..... 340/579
5,479,086 A * 12/1995 Konstanzer ..... 323/238
6,356,199 B1 * 3/2002 Niziolek et al. ..... 340/577

FOREIGN PATENT DOCUMENTS

DE 4122636 A1 * 1/1993
DE 4433425 A1 * 3/1996
DE 19632983 A1 * 2/1998
WO WO 99/19672 * 4/1999

* cited by examiner

*Primary Examiner*—Alfred Basichas
(74) *Attorney, Agent, or Firm*—Greer, Burns & Crain, Ltd.

(57) ABSTRACT

A flame measuring device, in particular for use in a regulating device for a burner, includes an ionization electrode which is arranged in a flame region of the burner. An ac voltage is applied to the ionization electrode whereby a dc voltage component is superimposed on an ionization current that flows through a resistor connected to the ionization electrode. The flame region influences the ac voltage and the dc voltage at a blocking capacitor unequally, and allows an ac voltage component to be separated from the dc voltage component by way of a first means. The separated ac voltage component can be compared to a separated-off dc voltage component by way of a second means in order to produce a pulse width-modulated signal.

6 Claims, 2 Drawing Sheets

MEASURING DEVICE FOR A FLAME

BACKGROUND OF THE INVENTION

1. Field of the Invention

The present invention concerns a measuring device for a flame. The invention also concerns a regulating device for a burner having the measuring device.

2. Description of the Prior Art

DE 19632 983 A1 discloses a measuring device for a flame and an associated regulating device in a gas burner, wherein a lambda reference value for low emissions is set by means of an ionization electrode. By means of a comparator, the analog signal is digitised for further processing. The signal produced by the comparator however involves only a slight signal variation and a small signal-noise spacing at the on-off threshold if the signal is also to be used for flame monitoring purposes.

SUMMARY OF THE INVENTION

The object of the present invention is to provide a measuring device for a flame, which permits more accurate and improved signal evaluation.

In accordance with the invention, there is provided a measuring device for a flame, in particular for use in a regulating device for a burner, comprising an ionization electrode which is positionable in the flame region of the burner and to which an ac voltage is applied whereby a dc voltage component is superimposed in dependence on the ionization current, wherein the ac voltage component which is influenced by the flame resistance can be separated from the dc voltage component by way of first means and the separated ac voltage can be compared to the separated-off dc voltage component by way of second means in order to produce a pulse width-modulated signal.

An important concept of the invention is that the alternating component which is influenced by the flame signal can be separated from the dc voltage component by way of first means and the separated alternating component can be compared to the separated-off dc voltage component in order to produce a pulse width-modulated signal.

Fluctuations in the amplitude in the supply voltage are compensated by the comparison of the alternating component to the direct component as both components change in terms of amplitude in the same relationship. In contrast changes in the flame, for example due to changes in the air ratio, influence the two components unequally.

Further advantages are the signal variation which can be adjusted in a wide range, the high level of sensitivity and the large signal-noise spacing as to whether the flame is on or off, and the fact that the analog signal is highly accurate and reproducible.

Further advantageous aspects of the invention are set forth in the dependent claims.

Thus, signal transmission by way of an optocoupler is possible, in which case both items of information, flame on and off and PWM-signal, can be transmitted by way of just one optocoupler. The ionization electrode can be designed to be shock-proof by virtue of the installation of contact shock-protection resistors.

BRIEF DESCRIPTION OF THE DRAWINGS

Some preferred embodiments of the apparatus and the method according to the invention are described in greater detail with reference to the accompanying drawings in which.

DESCRIPTION OF THE PREFERRED EMBODIMENT

Figure 1:
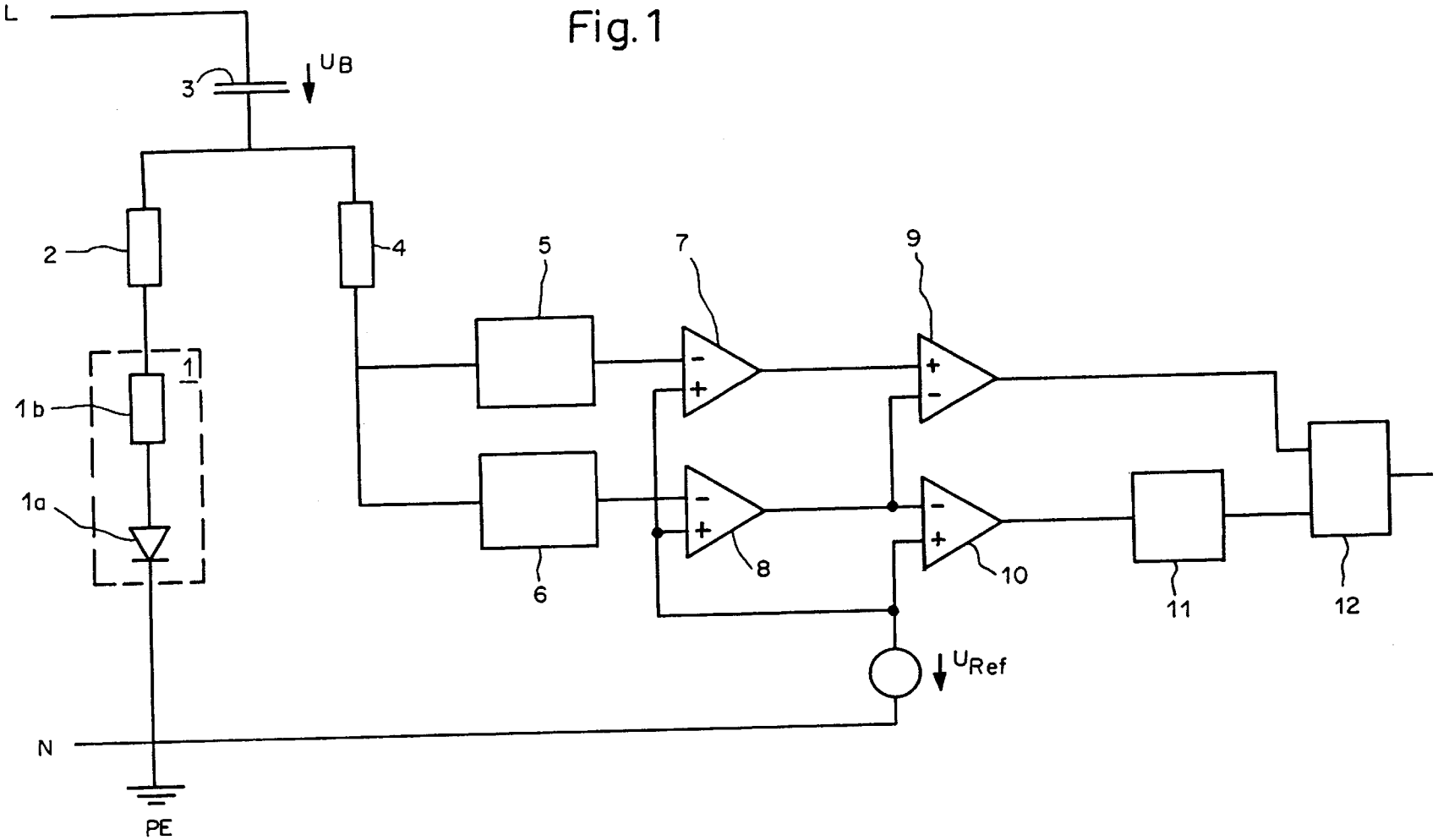
FIG. 1 shows a block circuit diagram of a structure according to the invention.

FIG. 1 diagrammatically shows the operating principle of the circuit according to the invention. At reference numeral 1 in an equivalent circuit, the flame 14 shown in FIG. 2 with an ionization electrode 15 is illustrated by means of a diode 1*a* and a resistor 1*b*. An ac voltage of for example 230V is applied by way of L and N. When a flame is present, a greater current flows through the blocking capacitor 3 in the positive half-wave than in the negative half-wave, because of the flame diode 1. As a result, a positive dc voltage $U_B$ is formed at the blocking capacitor 3 between L and a resistor 2 which is provided for the purposes of contact shock protection. A direct current therefore flows from N to the blocking capacitor 3 through a decoupling resistor 4. The magnitude of the direct current depends in that situation on $U_B$ and thus depends directly on the flame resistor 1*b*. The flame resistor 1*b* also influences the alternating current though the decoupling resistor 4, although to a different degree in relation to the direct current. Therefore a direct current and an alternating current flow though the resistor 4, as described above. A high pass filter 5 and a low pass filter 6 are connected downstream of the resistor 4. The alternating current is filtered out by the high pass filter 5, while the direct current component is blocked. The direct current component which is dependent on the flame resistor 1*b* is filtered out by the low pass filter, while the alternating current is substantially blocked. In an amplifier 7, the alternating current flowing out of the high pass filter 5 is amplified and a reference voltage $U_{Ref}$ is added. In an amplifier 8, the direct current flowing out of the high pass filter, with possibly slight alternating current components, is amplified and a reference voltage $U_{Ref}$ is added. The reference voltage $U_{Ref}$ can be selected to be of any value, for example $U_{Ref}=0$, but it is preferably so selected that the amplifiers and comparators require only one supply. At a comparator 9, the ac voltage $U_{18}$ which issues from the amplifier 7 and the dc voltage $U_{=}$ issuing from the amplifier 8 are compared to each other and a pulse width-modulated (PWM) signal is produced. If the amplitude of the mains voltage changes, the ac voltage and the dc voltage change in the same relationship and the PWM-signal does not change. The signal variation in the PWM-signal can be set by means of the amplifiers 7 and 8 in a wide range between $\tau=0$ and $\tau=50\%$ pulse duty factor.

The dc voltage component $U_{=}$ is compared in a comparator 10 to the reference voltage $U_{Ref}$. If a flame is present the dc voltage component is greater than the reference voltage ($U_{=}>U_{Ref}$) and the comparator output of the comparator 10 switches to 0. If there is no flame, the dc voltage component is approximately equal to the reference voltage ($U_{=}\approx U_{Ref}$). Because of the slight ac voltage component which is superimposed on the dc voltage component and which the low pass filter 6 does not filter out the dc voltage component is briefly below the reference voltage and pulses appear at the comparator output of the comparator 10. Those pulses are passed to a retriggerable monoflop 11. The monoflop is so triggered that the pulse series outputted from the comparator 10 comes more quickly than is the pulse duration of the monoflop. As a result if there is no flame a 1 constantly appears at the output of the monoflop. If a flame is present, the monoflop is not triggered and a 0 permanently appears at the output. The retriggerable monoflop 11 thus forms a "missing pulse detector" which converts the dynamic on/off signal into a static on/off signal.

Both signals, the PWM-signal and the flame signal, can now be separately subjected to further processing or linked by means of an or-member 12. When a flame is present, a PWM-signal appears at the output of the or-member 12, the pulse duty factor of that signal being a measurement in respect of the flame resistance 1*b*. If there is no flame, the output of the or-member is permanently at 1. The PWM-signal can be transmitted by way of an optocoupler (not shown) in order to provide protective separation between the mains side and the protection low-voltage side.

Figure 2:
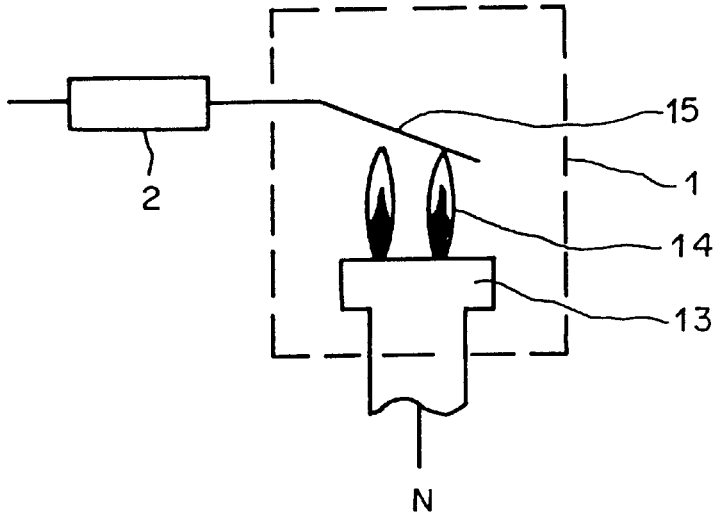
FIG. 2 shows the actual structure of the flame with an ionization electrode, which is shown in FIG. 1 as an equivalent circuit 1.

FIG. 2 shows that actual structure of the diode 1*a* and the resistor 1*b,* which are shown in FIG. 1 in the form of an equivalent circuit 1, as is known for example from DE 196 32 983 A1. A flame 14 can be produced by a burner 13. Projecting into the flame region 14 is an ionization electrode 15 which detects an ionization current. That depends on the flame resistance and thus the electrode temperature. The electrode temperature in turn depends on the lambda value and thus the air excess of the mixture to be burnt. The ratio of air to gas can be set by means of the lambda value. Usually, the lambda value is selected to be between 1.15 and 1.3 in order to achieve an over-stoichiometric ratio of air to gas.

It will be appreciated that the invention is not limited to the described and illustrated embodiments.

I claim:

1. A measuring device for a flame produced by a burner, in particular for use in a regulating device for the burner, comprising:

an ionization electrode which is positionable in the flame region of the burner;

means for applying an ac voltage component to said ionization electrode, said ac voltage component being influenced by the resistance of the flame;

means for superimposing a dc voltage component on said ac voltage, said dc voltage component being dependent on the ionization current;

a first filter for separating said ac component from said superimposed dc and ac voltage components;

a second filter for separating said dc voltage component from said superimposed dc and ac voltage components; and means for comparing said separated ac voltage component and said separated dc voltage component to produce a pulse width-modulated signal when a flame is present, the duty factor of said pulse width modulated signal being indicative of flame resistance.

2. A measuring device according to claim 1, wherein the ac voltage and the dc voltage component can be compared by means of a comparator.

3. A measuring device according to claim 1, wherein the dc voltage component is compared to a reference voltage by means of a comparator in order to be used as a flame indicating signal.

4. A measuring device according to claim 3, wherein the flame indicating signal is applied to a triggered monoflop in order to form a static on/off signal.

5. A measuring device according to claim 1, wherein a flame indicating signal which is triggered by way of a monoflop is linked to the pulse width-modulated signal in an or-member.

6. A measuring device according to claim 1, wherein at least one resistor is connected in series with the ionization electrode as contact shock protection.

* * * * *